US011591804B2

(12) United States Patent
Ylikangas et al.

(10) Patent No.: US 11,591,804 B2
(45) Date of Patent: Feb. 28, 2023

(54) BUILDING PANEL

(71) Applicant: Välinge Innovation AB, Viken (SE)

(72) Inventors: Roger Ylikangas, Lerberget (SE); Anders Nilsson, Helsingborg (SE); Karl Quist, Höganäs (SE)

(73) Assignee: VALINGE INNOVATION AB, Viken (SE)

( * ) Notice: Subject to any disclaimer, the term of this patent is extended or adjusted under 35 U.S.C. 154(b) by 54 days.

(21) Appl. No.: 17/029,644

(22) Filed: Sep. 23, 2020

(65) Prior Publication Data

US 2021/0087830 A1 Mar. 25, 2021

(51) Int. Cl.
*E04F 15/02* (2006.01)
*E04F 15/10* (2006.01)

(52) U.S. Cl.
CPC ..... *E04F 15/02038* (2013.01); *E04F 15/107* (2013.01); *E04F 2201/0146* (2013.01); *E04F 2201/0153* (2013.01); *E04F 2201/023* (2013.01); *E04F 2201/042* (2013.01); *E04F 2201/043* (2013.01); *E04F 2201/0511* (2013.01)

(58) Field of Classification Search
CPC ..... E04F 15/02038; E04F 15/107; E04F 2201/0146; E04F 2201/0153; E04F 2201/023; E04F 2201/042; E04F 2201/043; E04F 2201/0511; E04F 2201/0547
USPC ..... 52/578, 588.1, 589.1, 582.1, 591.5, 390, 52/391, 782.1
See application file for complete search history.

(56) References Cited

U.S. PATENT DOCUMENTS 7,568,322 B2 * 8/2009 Pervan ..... E04F 15/02038 52/792.11
7,707,793 B2 * 5/2010 Moriau ..... F16B 5/0016 52/592.1
7,908,815 B2 * 3/2011 Pervan ..... E04F 15/107 52/391

(Continued)

FOREIGN PATENT DOCUMENTS

WO WO 2006/043893 A1 4/2006
WO WO 2007/015669 A2 2/2007

(Continued)

OTHER PUBLICATIONS

Extended European Search Report issued in EP 19199233.8, dated Apr. 3, 2020, European Patent Office, Munich, DE, 9 pages.

(Continued)

*Primary Examiner* — Brent W Herring
(74) *Attorney, Agent, or Firm* — Buchanan Ingersoll & Rooney P.C.

(57) ABSTRACT

Building panels, such as a floor or wall panels. The panels include a first mechanical locking system include a first locking strip at one of the third edge or fourth edge configured to cooperate for horizontal locking with a first locking groove at the other of the third or fourth edge of an adjacent building panel, preferably by means of a folding motion, and a second locking system including a second locking strip at one of the first edge or second edge, configured to cooperate for horizontal locking with a second locking groove at the other of the first or second edge of an adjacent building panel. The thickness of the second locking strip, in a thickness-direction of the building panel, exceeds the thickness of the first locking strip.

16 Claims, 5 Drawing Sheets

(56) References Cited

U.S. PATENT DOCUMENTS

| | | | | |
|---|---|---|---|---|
| 8,033,074 | B2 * | 10/2011 | Pervan | E04F 15/107 52/391 |
| 8,293,058 | B2 * | 10/2012 | Pervan | E04F 15/04 156/265 |
| 8,359,805 | B2 * | 1/2013 | Pervan | E04F 15/18 52/391 |
| 8,631,622 | B2 | 1/2014 | Baert et al. | |
| 8,689,512 | B2 * | 4/2014 | Pervan | E04F 15/02038 52/748.11 |
| 8,763,341 | B2 * | 7/2014 | Pervan | E04F 15/02 52/391 |
| 9,314,936 | B2 * | 4/2016 | Pervan | B26D 1/14 |
| 10,358,830 | B2 * | 7/2019 | Pervan | E04C 2/38 |
| 11,053,691 | B2 * | 7/2021 | Pervan | E04F 15/02038 |
| 11,203,877 | B2 * | 12/2021 | Ylikangas | B27M 3/06 |
| 2003/0101681 | A1 * | 6/2003 | Tychsen | E04F 15/04 52/578 |
| 2005/0210810 | A1 * | 9/2005 | Pervan | E04F 15/02038 52/578 |
| 2006/0101769 | A1 * | 5/2006 | Pervan | E04F 15/02038 52/591.1 |
| 2008/0104921 | A1 * | 5/2008 | Pervan | E04F 15/04 52/588.1 |
| 2008/0110125 | A1 * | 5/2008 | Pervan | E04C 2/38 52/582.2 |
| 2008/0172971 | A1 * | 7/2008 | Pervan | E04F 15/02038 52/591.5 |
| 2013/0008118 | A1 * | 1/2013 | Baert | E04F 15/02038 156/60 |
| 2013/0111845 | A1 * | 5/2013 | Pervan | E04F 15/18 52/588.1 |
| 2015/0000221 | A1 * | 1/2015 | Boo | E04F 15/102 52/588.1 |
| 2019/0271165 | A1 | 9/2019 | Boo | |
| 2020/0308846 | A1 * | 10/2020 | Josefsson | E04F 15/02033 |
| 2021/0087827 | A1 * | 3/2021 | Ylikangas | E04F 15/02038 |
| 2021/0087828 | A1 * | 3/2021 | Ylikangas | B27M 3/06 |
| 2021/0087829 | A1 * | 3/2021 | Ylikangas | B27M 3/06 |
| 2021/0310256 | A1 * | 10/2021 | Boo | E04F 15/102 |
| 2022/0127850 | A1 | 4/2022 | Boo | |

FOREIGN PATENT DOCUMENTS

| | | | |
|---|---|---|---|
| WO | WO 2007/015669 | A3 | 2/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2009/116926 | A1 | 9/2009 |

OTHER PUBLICATIONS

International Search Report and Written Opinion dated Oct. 15, 2020 in PCT/EP2020/076579, European Patent Office, Rijswijk, NL, 10 pages.

Boo, Christian, U.S. Appl. No. 17/505,229 entitled "Building Panel with Locking System," filed in the U.S. Patent and Trademark Office filed Oct. 19, 2021.

Ylikangas, Roger, et al., U.S. Appl. No. 17/524,952 entitled "Building Panel," filed in the U.S. Patent and Trademark Office filed Nov. 12, 2021.

Ylikangas, Roger, et al., U.S. Appl. No. 17/642,348 entitled "Building Panel," filed in the U.S. Patent and Trademark Office filed Mar. 11, 2022.

Boo, Christian, U.S. Appl. No. 17/709,930 entitled "Building Panel and Locking Devices Therefore," filed in the U.S. Patent and Trademark Office filed Mar. 31, 2022.

* cited by examiner

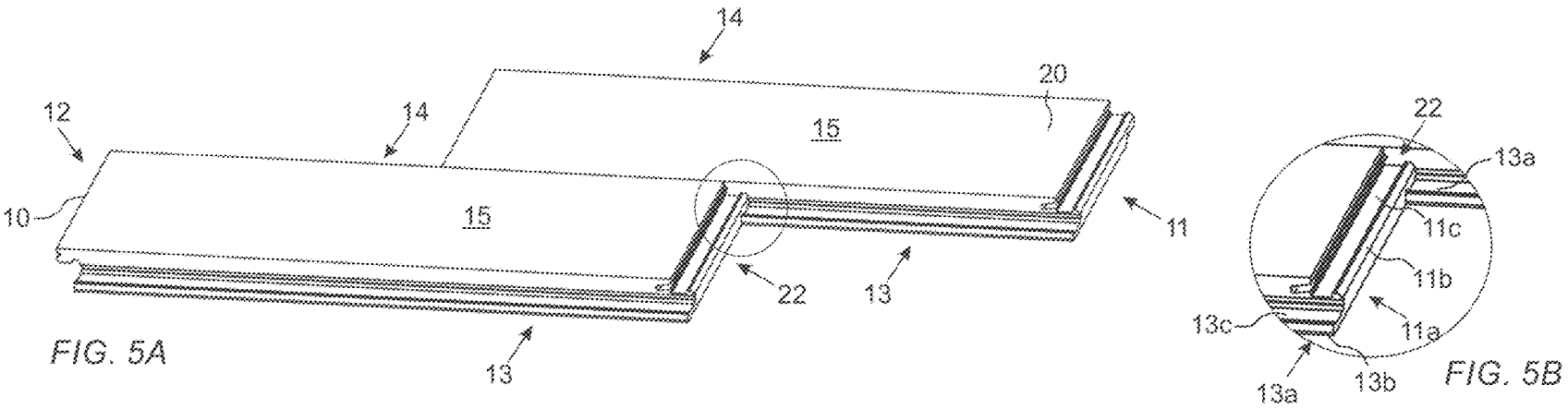
FIG. 5A
FIG. 5B
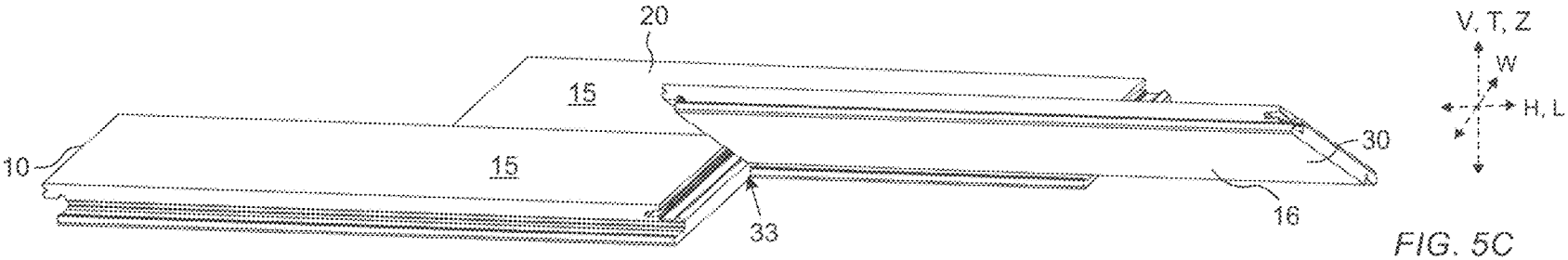
FIG. 5C
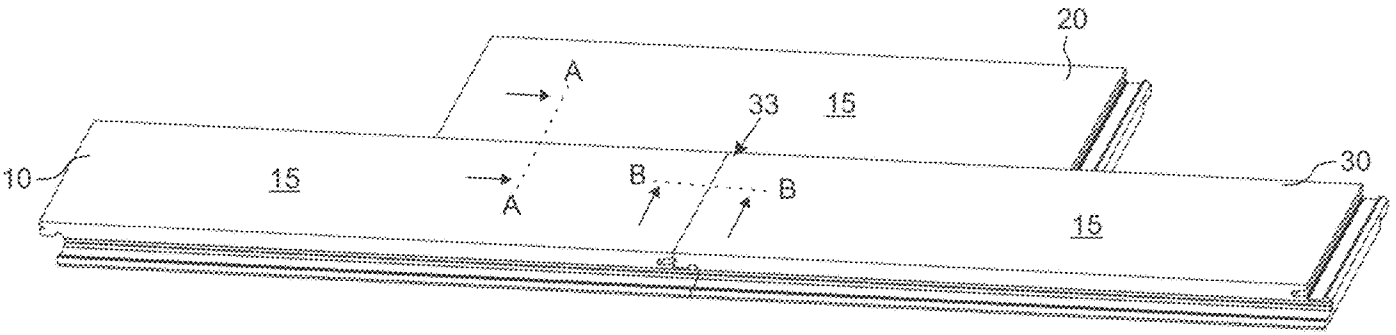
FIG. 5D

BUILDING PANEL

CROSS REFERENCE TO RELATED APPLICATION

The present application claims the benefit of European Application No. 19199233.5, filed on Sep. 24, 2019. The entire contents European Application No. 19199233.5 are hereby incorporated herein by reference in their entirety.

TECHNICAL FIELD

The disclosure generally relates to the field of mechanical locking systems for floor panels and building panels.

BACKGROUND

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Laminate floor panels of this type have been joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminium or HDF, which are integrated with the floor panel, i.e., joined with the floor panel in connection with the manufacture thereof.

The main advantages of floating floors with mechanical locking systems are that they are easy to install. They may also easily be taken up again and used once more at a different location. However, know systems suffer from drawbacks, for example in respect of water-tightness. As such, there is room for improvements in the technical field.

SUMMARY

An overall objective of the present disclosure is to provide a building panel which facilitates improved control of moisture, such as water. Improved moisture control may include, but is not limited to, improved sealing between assembled building panels, improved resistance to water penetration through a surface comprising assembled building panels.

The above objects of embodiments of the disclosure may be achieved wholly or partly by locking systems and floor panels according to the disclosure. Embodiments of the disclosure are evident from the description and drawings.

Definition of Some Terms

In the following text, the visible surface of the installed floor panel is called "front surface", while the opposite side of the floor panel facing the subfloor is called "rear surface". "Horizontal plane" relates to a plane, which is parallel to the front surface. Directly adjoining upper parts of two neighboring joint edges of two joined floor panels together define a "vertical plane" perpendicular to the horizontal plane. The outer parts of the floor panel at the edge of the floor panel between the front side and the rear side are called "joint edge". The joint edge has several "joint surfaces" which can be vertical, horizontal, angled, rounded, beveled etc. These joint surfaces can exist on different materials, for instance laminate, fiberboard, wood, plastic, metal (in particular aluminum) or sealing materials.

By "vertical locking" is meant locking parallel to the vertical plane. By "horizontal locking" is meant locking parallel to the horizontal plane.

By "up" is meant towards the front surface, by "down" towards the rear surface, by "inwardly" mainly horizontally towards an inner and centre part of the panel and by "outwardly" mainly horizontally away from the centre part of the panel.

By "locking" or "locking system" are meant cooperating connecting means which interconnect the floor panels vertically and/or horizontally. By "mechanical locking system" is meant that locking can take place without glue. Mechanical locking systems can in many cases also be joined by glue.

By "vertical locking" is meant locking parallel to the vertical plane and by "horizontal locking" is meant locking parallel to the horizontal plane.

By "vertical locking surfaces" is meant the upper and lower cooperating tongue surfaces in the tongue in a first edge cooperating with upper and lower cooperating tongue groove surfaces in the tongue groove in an adjacent second edge locking the adjacent edges vertically.

By "horizontal locking surfaces" is meant an essentially vertical upper tongue groove edge and a locking element in the second edge cooperating with an essentially vertical upper tongue edge and a locking groove in the adjacent first edge, the cooperating horizontal locking surfaces lock the adjacent edges horizontally.

By "locking groove side" is meant the side of the floor panel in which part of the horizontal locking consists of a locking groove whose opening faces to the rear side. By "locking element side" is meant the side of the floor panel in which part of the horizontal locking consists of a locking element, which cooperates with the locking groove.

By "decorative surface layer" is meant a surface layer, which is mainly intended to give the floor its decorative appearance. "Wear resistant surface layer" relates to a high abrasive surface layer, which is mainly adapted to improve the durability of the front side. This conclude in that a "decorative wear resistant surface layer" is a layer, which is intended to give the floor its decorative appearance as well as improve the durability of the front side. A surface layer is applied to the core.

Embodiments of the present disclosure are particularly suitable for use in floating floors, which are formed of floor panels which are joined mechanically with a locking system integrated with the floor panel, i.e., mounted at the factory, are made up of one or more upper layers of wood or wood veneer, decorative laminate, powder based surfaces or decorative plastic material, an intermediate core of wood-fibre-based material or plastic material and preferably a lower balancing layer on the rear side of the core. Floor panels of solid wood or with a surface layer of cork, linoleum, rubber or soft wear layers, for instance needle felt glued to a board, printed and preferably also varnished surface and floors with hard surfaces such as stone, tile and similar materials are included.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of embodiments of the invention. The panels may be square. It should be emphasized that embodiments of the disclosure may be used in any floor panel and it may be combined with all types of known locking system formed on the long edges and/short edges, where the floor panels are intended to be joined using a mechanical locking system connecting the panels in the horizontal and/or vertical directions on at least two adjacent edges.

In one aspect of the disclosure there is provided a set of similar or essentially identical building panels, such as a floor or wall panels, comprising a first mechanical locking system at respective opposite and parallel third and fourth edges, such as long edges. The first locking system comprising a first locking strip at one of the third edge or fourth edge having a first locking element configured to cooperate for horizontal locking with a first locking groove at the other of the third or fourth edge of an adjacent building panel, preferably by means of a folding motion, and a second locking system at respective opposite and parallel first and second edges, such as short edges. The second locking system comprising a second locking strip at one of the first edge or second edge, having a second locking element configured to cooperate for horizontal locking with a second locking groove at the other of the first or second edge of an adjacent building panel. The thickness of the second locking strip, in a thickness-direction of the building panel, exceeds the thickness of the first locking strip.

Further embodiments and advantages being described in the detailed description and the appended claims.

BRIEF DESCRIPTION OF DRAWINGS

The disclosure will in the following be described in connection to exemplary embodiments and in greater detail with reference to the appended exemplary drawings, wherein:

FIG. 5A illustrates building panels according to an embodiment of the disclosure assembled by a folding motion.

FIG. 5B shows details of the building panels of FIG. 5A.

FIG. 5C illustrates building panels according to embodiments of the disclosure assembled by vertical folding.

FIG. 5D illustrates building panels assembled in locking position according to embodiments of the disclosure.

DETAILED DESCRIPTION

Embodiments of the disclosure will now be described with reference to the appended schematic drawings. It should be emphasized that improved or different functions may be achieved using combinations of the embodiments.

All embodiments may be used separately or in combinations. Angles, dimensions, rounded parts, spaces between surfaces, etc. are only examples and may be adjusted within the basic principles of the disclosure.

Figure 1:
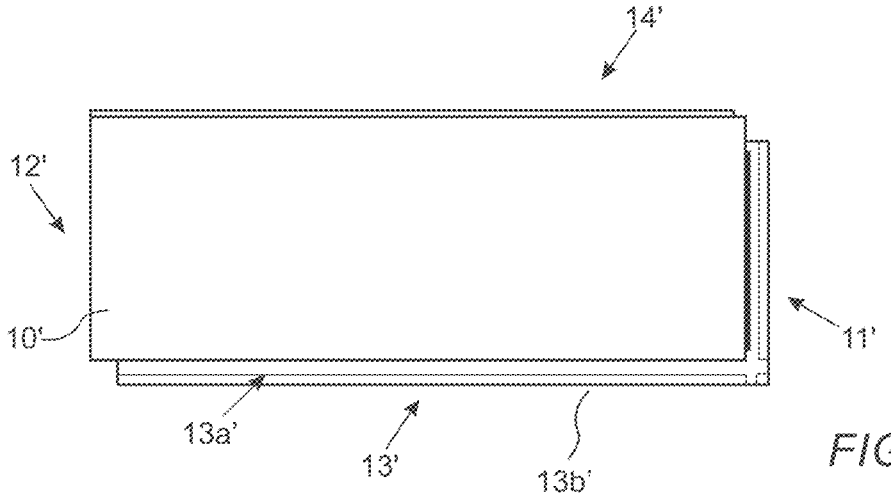
FIG. 1 illustrates a floor board comprising locking systems according to known technology.

A known building panel comprising mechanical locking systems is illustrated in FIG. 1.

A mechanical locking system typically comprises a tongue and a tongue groove for vertical locking and a locking element and a locking groove for horizontal locking. It typically has at least four pairs of active cooperating locking surfaces, two pairs for vertical locking and two pairs for horizontal locking. The locking system comprises several other surfaces, which generally are not in contact with each other and can therefore be produced with considerably larger tolerance then the cooperating locking surfaces.

Laminate floorings are usually composed of a core consisting of a 6-9 mm fiberboard, a 0.20 mm thick upper surface layer and a lower balancing layer. The surface layer provides appearance and durability to the floor panels. The core provides stability and the balancing layer keeps the board level when the relative humidity (RH) varies during the year.

FIGS. 1, 2A-2B and 3 illustrate according to known art a typical first mechanical locking system (strip lock), which can be locked with angling and which is widely used on the market. Such a locking system can also be designed to be locked with vertical or horizontal snapping as will be explained herein. FIG. 4A shows a vertical cross section of the floor panel a part of a long side 13' of the floor panel 20', as well as a part of a long side 14' of an adjoining floor panel 10'. The bodies of the floor panels 10', 20' can be composed of a fiberboard body or core, which supports here, a wear resistant and decorative surface layer on its front side and a balancing layer on its rear side (underside). The locking system has a tongue 14*h'* and a tongue groove 13*j'* which locks the panels in a vertical direction with upper and lower tongue surfaces that cooperate with upper and lower tongue grooves surfaces. A locking strip 13*a'* is formed from the body and balancing layer of the floor panel 20' and supports a locking element 13*b'*. Therefore the locking strip 13*a'* and the locking element 13*b'* in a way constitute an extension of the lower part of the tongue groove 13*j'*. The locking element 13*b'* formed on the strip 13*a'* has an operative locking element surface 13*m'* which cooperates with an operative locking groove surface 14*m'* in a locking groove 14*g'* in the opposite locking groove side of the adjoining floor panel 10'. By the engagement between the horizontal operative locking surfaces 13*m'*, 14*m'* a horizontal locking of the floor panels 10', 20' transversely of the joint edge is obtained if the panels are pulled apart.

Figure 3:
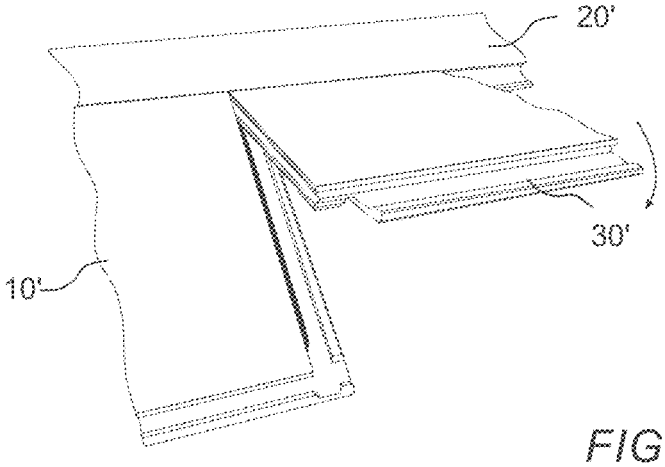
FIG. 3 illustrates a floor board being assembled to the floorboards of FIG. 2A by means of a vertical folding.
Figure 4A:
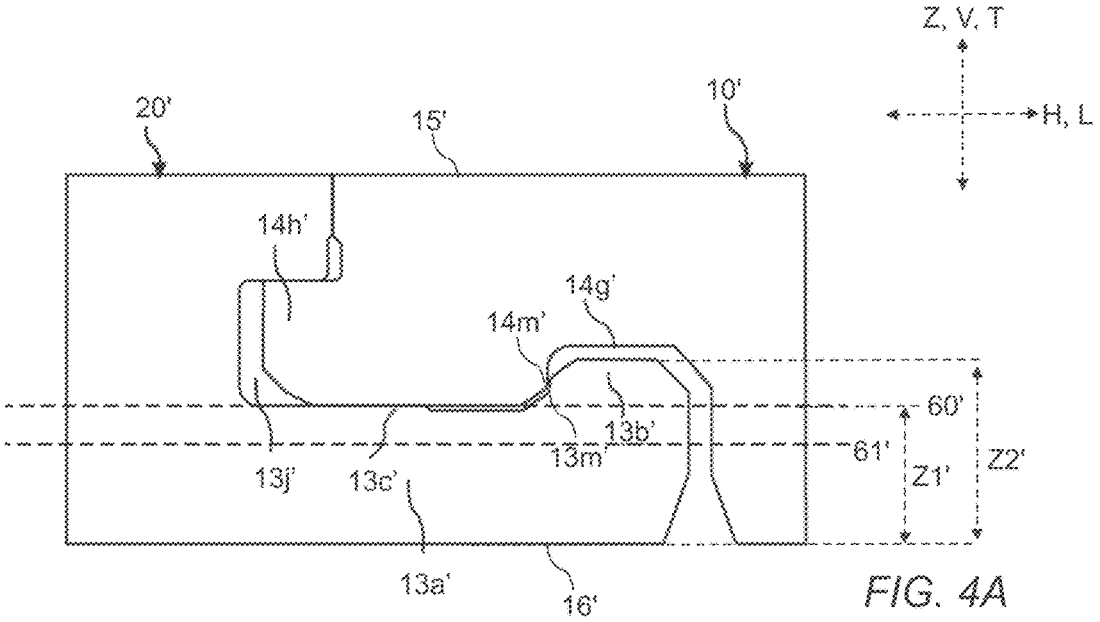
FIG. 4A shows a cross sectional view of a first locking system according to known technology.
Figure 4B:
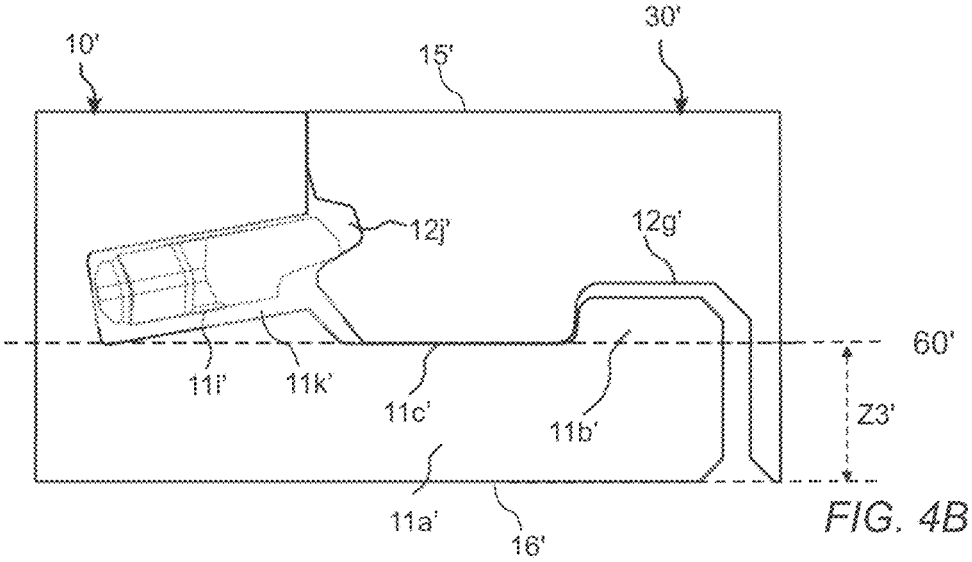
FIGS. 4B-4C show cross sectional views of second locking systems according to known technology.
Figure 4C:
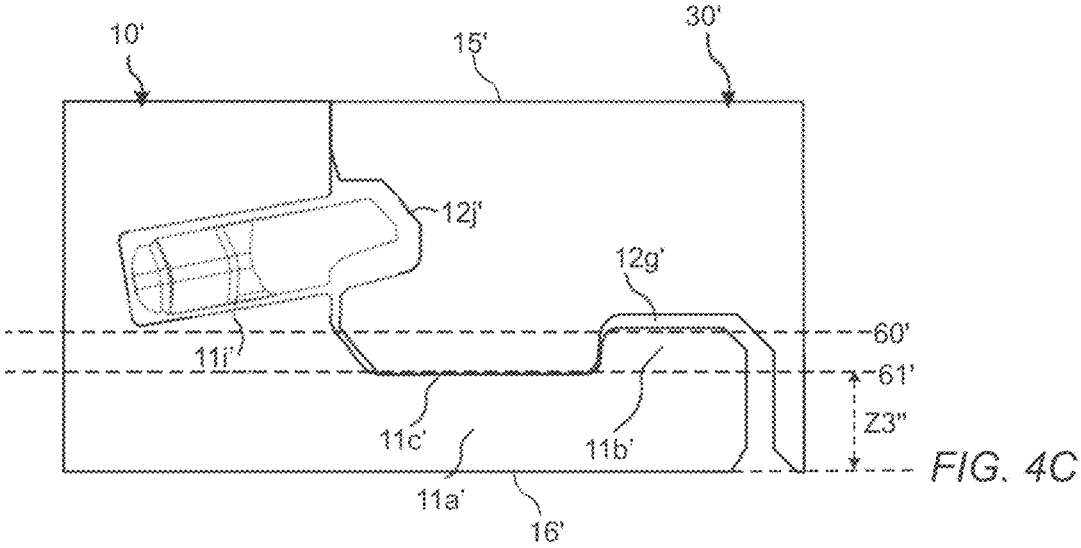

A known second locking system, shown in FIGS. 4B-C, can also be formed with a flexible tongue 11*i'* (fold lock) typically used at short edges 11', 12' as shown in FIGS. 4B-C, which can be displaced during locking. Such a locking system can be locked with a vertical movement as shown in FIG. 3.

As derivable from FIGS. 4A-C, the upper surface 11*c'* of the second locking strip 11*a'* is disposed in one of: a common plane 60 to that of the first locking strip 13*a*' as derivable from comparing FIG. 4A and FIG. 4B, or a plane 61' disposed vertically displaced below the upper surface 13*c*' of the first locking strip 13*a*', i.e., towards the rear surface 16' of the panel, vertically below the plane 60', as derivable from comparing FIG. 4A and FIG. 4C.

The displaceable tongue 11*i*' is configured to cooperate with the second tongue groove 12*j*' for locking in a vertical direction. The displaceable tongue 11*i*' is a separate part and is made of, e.g., plastic, and inserted in a displacement groove 11*k*' at the first edge 11' of the first panel 10'. The tongue 11*i*' is pushed into a displacement groove 11*k*' during a vertical assembling of the first and the second edge of the first and the second panel. The displaceable tongue 11*i*' springs back and into the second tongue groove 12*j*' at the second edge 12' of the panel 30' when the panels have reached a locked position.

A third 13' and a fourth edge 14' of the panels are provided with the first locking system, which enables assembling to an adjacent panel 20' by an angling movement, to obtain a simultaneous assembling of the first 11' and the second 12' edges and the third 13' and the fourth edges 14' as shown in FIG. 3.

Figure 2A:
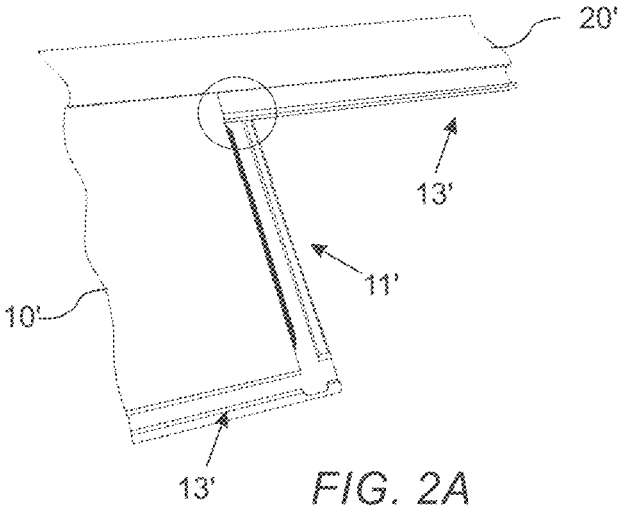
FIG. 2A illustrates the floor board of FIG. 1 in locked position with an adjacent identical building panel.
Figure 2B:
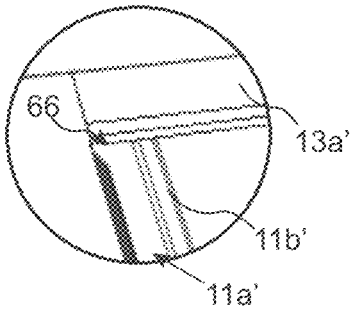
FIG. 2B shows details of the floor boards of FIG. 2A.

As derivable from FIGS. 2A and 2B a gap 66 is formed between locking strip 11*a*' of first edge 11' of first panel 10' and locking strip 13*a*' of the third edge 13' of adjacent panel 20'.

Thereby, moisture, such as water, may penetrate between the first edge 11' of first panel 10' and the second edge 12' of the adjacent panel 20' via the gap 66.

Also, moisture which penetrate in between first edge 11' of first panel and second edge of an adjacent panel along the first edge 11' is collected by and/accumulates on the second locking strip 11*a*' of the first panel and flows along the second locking strip 11*a*' to the gap 66, whereby the fluid penetrates to the rear surface 16' of the panels.

FIG. 4A shows a cross sectional view of a known first locking system typically provided on respective opposite and parallel long edges of a panel.

FIGS. 4B-C show cross sections of different embodiments of known second locking systems typically provided on respective opposite and parallel short edges of a panel.

As derivable from FIG. 4A, an upper surface 13*c*' of locking strip 13*a* of the third edge, such as a long edge, is provided in a first plane 60. The distance Z1', in the Z-direction, denotes the distance between the rear surface 16' and the upper surface 15. The distance Z2', in the Z-direction, denotes the distance between the rear surface 16' and an upper surface of the locking element 13*b*'.

As derivable from FIG. 4B an upper surface 11*c*' of locking strip 11*a*' of the first edge, such as a short edge, is provided in the first plane 60'. Thus, the upper surface 11*c*' of the locking strip 11*a*' is provided in the same plane as the upper surface 13*c*' of the locking strip 13*a*' of the third edge 13', such as a long edge. The distance Z3', in the Z-direction, denotes the distance between the rear surface 16' and the upper surface 11*c*'.

As derivable from FIG. 4C an upper surface 11*c*' of locking strip 11*a*' of the first edge, such as a short edge, is provided in a second plane 61'. The second plane 61' being disposed vertically below the first plane 60', i.e., closer to the rear surface 16' than the first plane 60'. The distance Z3", in the Z-direction, denotes the distance between the rear surface 16' and the upper surface 11*c*' and Z1' exceeds Z3" as derivable from FIGS. 4A and 4C.

The third panel 30' with the first tongue groove 12*j*' is displaced in relation to the first panel 10' with the displaceable tongue 11*i*', which is pushed into a displacement groove 11*k*' by an edge of the third panel 30'. The displaceable tongue 11*i*" springs back, and into the second tongue groove 12*j*', when the panels have reached an assembled position, and locks the first and the third panels vertically.

Exemplary embodiments of the disclosure are shown in FIGS. 5A-D, 6A-B, 7 and 8.

Figure 7:
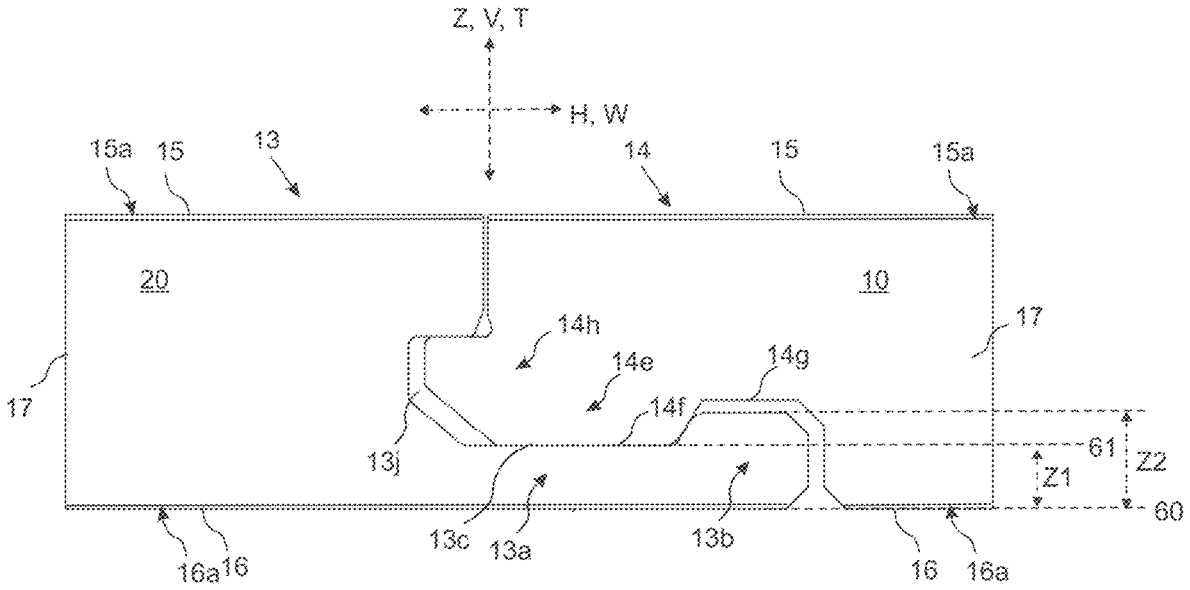
FIG. 7 illustrates the A-A cross sectional view of the embodiment of FIG. 5D.
Figure 8:
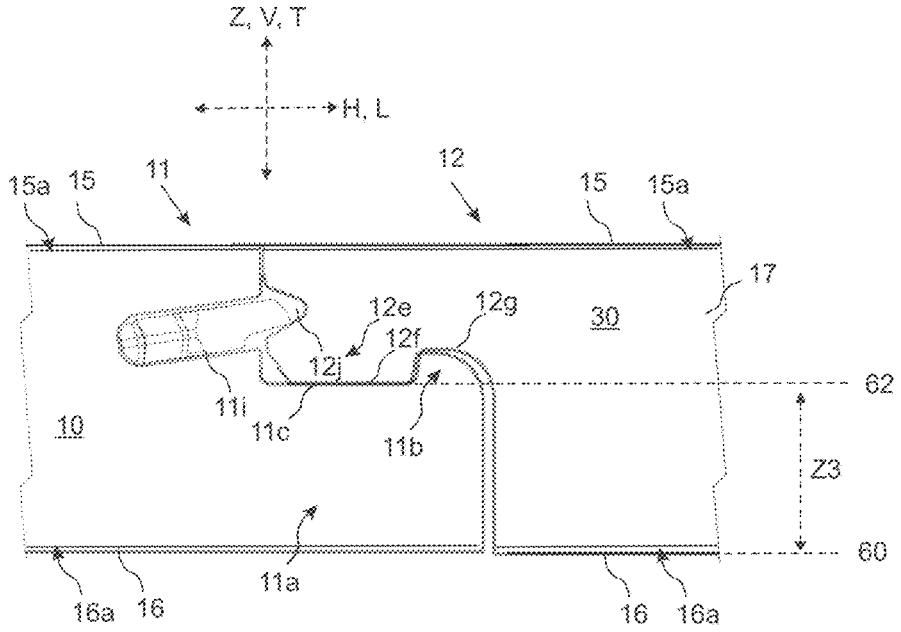
FIG. 8 illustrates the B-B cross sectional view of the embodiment of FIG. 5D.

Referring to FIG. 7, a first mechanical locking system formed with a tongue and groove configuration is provided. According to embodiments of the present disclosure, the fourth edge 14 may comprise a first locking protrusion 14*e* such as a locking tongue 14*h*, provided with a first lower edge surface 14*f*. Referring to FIG. 8, the second locking system may be formed with a tongue and groove configuration. According to embodiments of the present disclosure, the second edge 12 may be provided with a second locking protrusion 12*e*, provided with a second lower edge surface 12*f* as shown in FIG. 8. Preferably the first and second lower edge surfaces 14*f*, 12*f* are configured to cooperate with a respective of the first and second upper surfaces 13*c*, 11*c* of a first and a second locking strip 13*a*, 11*a* of adjacent panel, such as the second 20 or first panel 10 as shown for instance in FIG. 7 or FIG. 8 respectively.

The second mechanical locking system may be formed at one of a first 11 or second 12 short edge, such as a first edge, of similar, preferably essentially identical panels 10, 20, 30, 40, 50. The second mechanical locking system may be configured for locking the first edge 11 of a first panel 10 to the second edge of an adjacent panel, such as the third panel 30, in a plane, and in a vertical and/or in horizontal directions perpendicular said first and second edge towards and away from each other. An embodiment of the second mechanical locking system enables assembling of the first and the third panels by vertical folding of the second edge of the third panel 30 relative the first edge 11 of the first panel 10. The term vertical folding may entail that the second locking system is configured to enable assembling of panels to obtain a locking position by means a vertical motion, such as parallel displacement of the panel 30, such as a plane of the panel 30, which may be include the plane of the front surface 15. Thus, the term vertical motion as used herein may include vertical folding.

The mechanical locking systems are preferably formed by mechanical cutting, such as milling, drilling and/or sawing, of the edges of the panels and may according to embodiments be provided with a displaceable tongue 11*i*, preferably of plastic. The displaceable tongue 11*i* may be bendable and provided with protruding bendable parts, such as the displaceable tongues disclosed in WO 2006/043893 and WO 2007/015669. The displaceable tongue 11*i* may also be configured to be locked by a movement along the first and the second edge, such as the displaceable tongues disclosed in WO 2009/116926 and WO 2008/004960.

Each panel may be of a rectangular shape and the first mechanical locking system may comprise a first tongue groove 13*j* at one of a third edge 13 or fourth 14 long edge, for example the third edge 13, and a first locking tongue 14*h* at the other of the third or fourth edge, for example the fourth edge 14. The first locking tongue 14*h* and the first tongue groove 13*j* may be configured to cooperate for locking of the third and the fourth edge 13, 14 in a vertical V direction. The first mechanical locking system may typically further comprise a first locking strip 13*a* at the third edge 13, provided with a vertically protruding first locking element 13*b*, a first locking groove 14*g* at a fourth edge 14. The first locking element 13*b* is configured to cooperate with the first locking groove 14*g* for locking of the third 13 and the fourth edge 14 in a horizontal direction, in particular away from each other and perpendicular said third and fourth edge, as is shown in, e.g., FIG. 7.

The second mechanical locking system shown for instance in FIG. 8 may comprise a second locking strip 11*a* at the first edge 11 provided with a vertically protruding second locking element 11*b* and a second locking groove 12*g* at a second edge 12.

Embodiments of the second locking system may comprise a second locking tongue, preferably in the shape of a displaceable tongue 11*i* arranged in a displacement groove 11*k* at the first edge 11 of the first panel 10.

The displaceable tongue 11*i* is configured to cooperate with a first tongue groove 12*j* formed at the other of the first 11 or second edge 12, for locking of the first and the second edge 11, 12 in a vertical V direction.

The second locking system may alternatively comprise a tongue and groove configuration similar to the first locking system, i.e., with the locking tongue integrally formed with the panel.

The second edge 12 may be provided with a second locking protrusion 12*e* configured to be received in the second locking strip 11*a* for horizontal locking of the first edge of a panel to the second edge of an adjacent panel. The second locking protrusion 12*e* may be provided with a second lower edge surface 12*f* configured to face a second upper surface 11*c* of an adjacent second panel when the respective second locking system of the first and second panel are configured in locking engagement with each other. The second lower edge surface 12 may according to some embodiments abut the second upper surface 11*c* when two panels are configured in locking engagement. Thus, the second lower edge surface 12*f* may be configured to cooperate with a second upper surface 11*c* of the second locking strip 11*a* of an adjacent panel 10. The first lower edge surface 12*f* of the building panel is therefore according to some embodiments arranged in the same plane 62 as the first upper surface 11*c* of the first locking strip 11*a* when the first and second edge of two adjacent panels are configured in locking engagement with each other.

The fourth edge 14 is may be provided with a first locking protrusion 14*e*, which may form part of the first locking tongue 14*h*, and comprising a first lower edge surface 14*f* configured to cooperate with a first upper surface 13*c* of the first locking strip 13*a* of an adjacent panel 20. The lower edge surface 14*f* of the building panel may therefore according to embodiments be arranged in the same plane 61 as the first upper surface 13*c* of the first locking strip 13*a*.

As derivable for example from FIG. 5A and FIG. 5B, the second locking strip 11*a* may extend, in the width-direction W, along the entire front surface 15 of the panel 10. It is thus facilitated that the second locking strip 11*a* may at least to some extent overlap or partially overlap or completely overlap the first locking strip 13*a* of an adjacent panel 20 when panels 10 and 20 are assembled in locking position by means of the first locking system, i.e. along the long edges.

Preferably, the second locking strip 11*a* may at least partially overlap or fully cross the first locking element 13*b* of the adjacent panel 20 when the panels 10, 20 are assembled in locked position by means of the first mechanical locking system. The configuration facilitates that an end portion of the second strip 11*a* may abut the core 17 of the adjacent panel 20 inboard the first locking element 13*b*, as shown in FIG. 5B. Thereby, improved sealing may be facilitated.

The first edge 11 and the second edge 12 may be respective short edges, such as shortest edges, of the building panel 10. The third edge 13 and the fourth edge 14 may be respective long edges, such as longest edges, of the building panel 10.

As derivable from FIG. 8, the distance Z3, in this case the thickness of the second locking strip 11*a*, in a thickness direction Z, may exceed than the distance Z1, in this case the thickness of the second locking strip 11*a* shown in FIG. 7.

The rear surface 16 of the panel may extend in a first plane 60. The upper surface 13*c* of the first locking strip 13*a* may extend in a second plane 61 and the upper surface 11*c* of the second locking strip 11*c* may extend in a third plane 62.

The first, second and third planes 60, 61, 62 may be parallel. The second plane 61 may extend between the third plane 62 and the first plane 60.

The distance Z3, in the thickness-direction Z, between rear surface 16 and the second upper surface 11*c* of the second locking strip 11*a* may be greater than and/or exceed a distance Z1, in the thickness-direction Z, between the rear surface 16 and the first upper surface 13*c* of the first locking strip 13*a*.

As derivable from FIGS. 7 and 8, the distance Z3 may exceed the distance Z2 between the rear surface 16 and an upper surface of the first locking element 13*b*.

The second locking strip 11*a* may be homogenous and extend from the rear surface 16 at least to the third plane 62.

The thickness of the second locking strip 11*a*, corresponding to the distance Z3 may be constant along the entire length (in the width-direction W) of the second locking strip 11*a*, optionally, disregarding the formation of first locking groove 14*g* in the second locking strip 11*a*, the thickness Z3 of the second locking strip 11*a* may be constant along the remainder of length (in the width-direction W) of the second locking strip 11*a*.

The distance Z3 between the plane of the rear surface 16 and the second upper surface 11*c* may be constant along the entire length (in the width-direction W) of the second locking strip 11*a*.

Courtesy of the thickness of Z3 of the second locking strip 11*a* exceeding thickness of Z1 of the first locking strip 13*a*, it may be facilitated that the first locking groove 14*g* can be formed in the second locking strip 11*a*. It may thus be facilitated that the second locking strip 11*a* may receive the first locking element 13*b*.

Thereby, improved locking may be obtained. Thereby, the second locking strip 11*a* may overlap the first locking strip 13*a*.

It is thereby facilitated that the second locking strip 11*a* may at least overlap the first locking element 13*b* of an adjacent panel. Thereby, improved sealing is facilitated.

The third plane 62 of the second upper surface 11*c* of the second locking strip 11*a* may be disposed vertically displaced relative the second plane 61 of a first upper surface 13*c* of the first locking strip 13*a* such that the first and second plane 60, 61 extend in parallel, wherein the third plane 62 is arranged between the second plane 61 and the front surface 15.

The plane of the upper surface 11*c* of the second locking strip 11*a* of a first panel 10 may be disposed vertically displaced relative the first upper surface 13*c* of the first locking strip 13*a* of an adjacent further panel, such as the second panel 20 when the first 10 and further panel 20 are assembled in locking position by means of the first locking system.

Thereby, an end portion of the second locking strip 11*a* of the first panel 10 may be arranged vertically V above, i.e. in the thickness direction T, the first locking element 13*b* of an adjacent panel when the two panels are assembled in locking position.

Thereby, an end portion of the second locking strip 11*a* of the first panel 10 may be arranged vertically V above, i.e. in the thickness direction T, the first locking strip 13*a* of an adjacent panel when the two panels are assembled in locking position.

The second upper surface 11*c* of the second locking strip 11*a* may be disposed in and/or extends in a plane between the second upper surface 13*c* and the front surface 15 of the panel 10.

The first and second lower edge surfaces 14*f*, 12*f* may respectively extend in vertically displaced planes, such as to extend in parallel.

The upper surface 11*c* of the second locking strip 11*a* of the panel 10 and the second lower edge surface 12*f* of the locking protrusion 12*e* of the second edge 12 of an adjacent panel, such as panel 20, may extend in a common plane when the second locking system of respective first and second panels 10, 20 are assembled in locking position.

An end portion, in the width direction of the panel 10, of the second locking strip 11*a* may be configured to overlap the first locking strip 13*a* of an adjacent building panel 20 when the first locking groove 14*g* cooperates with the first locking element 13*b* of an adjacent building panel 20.

The second locking strip 11*a* and the first locking protrusion 14*e* may intersect, preferably the second locking strip 11*a* and the first locking protrusion 14*e* forms a common end portion.

It is thereby be facilitated that the common end portion may be adapted to cooperate with both first locking strip of adjacent panel 20 and second locking protrusion 12*e* of adjacent panel 30.

An end portion of the second locking strip 11*a* in respect of the width direction W of the panel, of the first panel 10 may intersect and overlap an end portion, in respect of the length direction L of the panel, of the first locking groove 14*e* of the same building panel 10.

It is thereby be facilitated that the common end portion may be adapted to cooperate with both first locking strip of adjacent panel 20 and second locking protrusion 12*e* of adjacent panel 30.

A corner of the building panel 10 may comprise, in a direction transverse the front surface of the building panel; a portion of the second locking strip 11*a* and a portion of the first locking tongue 14*h* in said sequence.

The above features may thus facilitate that there is an absence of gap 66, in the width-direction W, between an outermost end portion of the second locking strip 11*a*, in the transverse direction of the panel, in proximity of the fourth edge 14, and the first locking strip 13*a* of an adjacent third panel. This configuration may facilitate that moisture, such as water, may not drain from the second locking strip 11*a* of panel 10 to the rear side 16 of panel 10, when the first and third panels are assembled in locked position, but rather drain to the first locking strip 13*a* of an adjacent panel, such as panel 20.

According to embodiments, moisture, such as water, may be prevented from flowing in a vertical direction, such as in a direction along the Z-axis and/or thickness direction Z, in between the second locking strip 11*a* and the first locking strip 13*a* of an adjacent panel from an edge portion of the front surface 15 of the first panel 10 to an edge portion of the rear surface 16 of the first panel 10.

Because the above described configuration of the first and second locking strips 13*a*, 11*a*, double-layered joint 22 may be obtained at the intersection of a second locking strip 11*a* of a first panel 10 and the first locking strip 13*a* of a further panel 20, when the first 10 and further panel 20 are assembled in locking position, as shown in FIG. 5B.

Embodiments of the disclosure described above may facilitate that moisture, such as liquid, may, e.g., by means of gravitational force, flow from the front surface 15 onto the second locking strip 11*a* and subsequently along the second locking strip 11*a*, in particular along the second upper surface 11*c* thereof, and onto the first locking strip 13*c* of an adjacent third panel 30 when the respective first locking system of the first panel 10 and an adjacent panel, such as the fifth panel 50, are assembled in locked position.

Embodiments of the disclosure described above may facilitate that when a further panel, such as a third panel 30, assembled to first edge 11 of first panel 10 by vertical movement while simultaneously assembled with its fourth edge 14 to the third edge 13 of the second panel 20 by means of folding, a triple-layered joint 33 may be obtained at the intersection of the three panels 10, 20, 30, as shown in FIGS. 5C-D. The triple-layered joint 33 may thus comprise respective portions of three adjacent panels interlocked and/or arranged stacked on top of each other in the thickness direction T.

The second locking strip 11*a* the first locking tongue 14*h* may overlap at respective end portions thereof, preferably a position where the first edge 11 and the fourth edge 14 intersect, preferably to form a right-angle, when two adjacent panels are assembled in locking position by means of the first locking system.

The first locking tongue 14*h* of the similar or essentially identical panels may be continuous with the second locking strip 11*a*, via a transition portion or a common end portion comprising both a portion of the first locking tongue 14*h* and a portion of the second locking strip 11*a*.

The second locking strip 11*a* and the first locking tongue 14*h* may be comprised in the same entity, such as the core 17 of the panel.

The second locking strip 11*a* may comprise a portion, such as an outermost portion, in the length direction L, of the first locking groove 14*g*.

The second locking strip 11*a* may comprise a portion, such as an outermost portion, in the length direction L, of the first locking tongue 14*h*.

An outermost edge of the second locking strip 11*a* may be continuous with the fourth edge 14, as illustrated in FIGS. 5A-D.

The second locking strip 11*a* may extend along substantially the entire front surface 15 and/or surface layer 15*a*, in the width direction W, as shown in FIGS. 5A-D.

The outermost edge portion of the second locking strip 11*a* may be configured to extend to overlap the first locking strip 13*a* of an adjacent panel and abut the core 17 of an adjacent panel, when the first 10 and adjacent panel 20 are assembled in locked position by means of the first locking system. Thereby, improved sealing is facilitated.

Figures 6A, 6B:
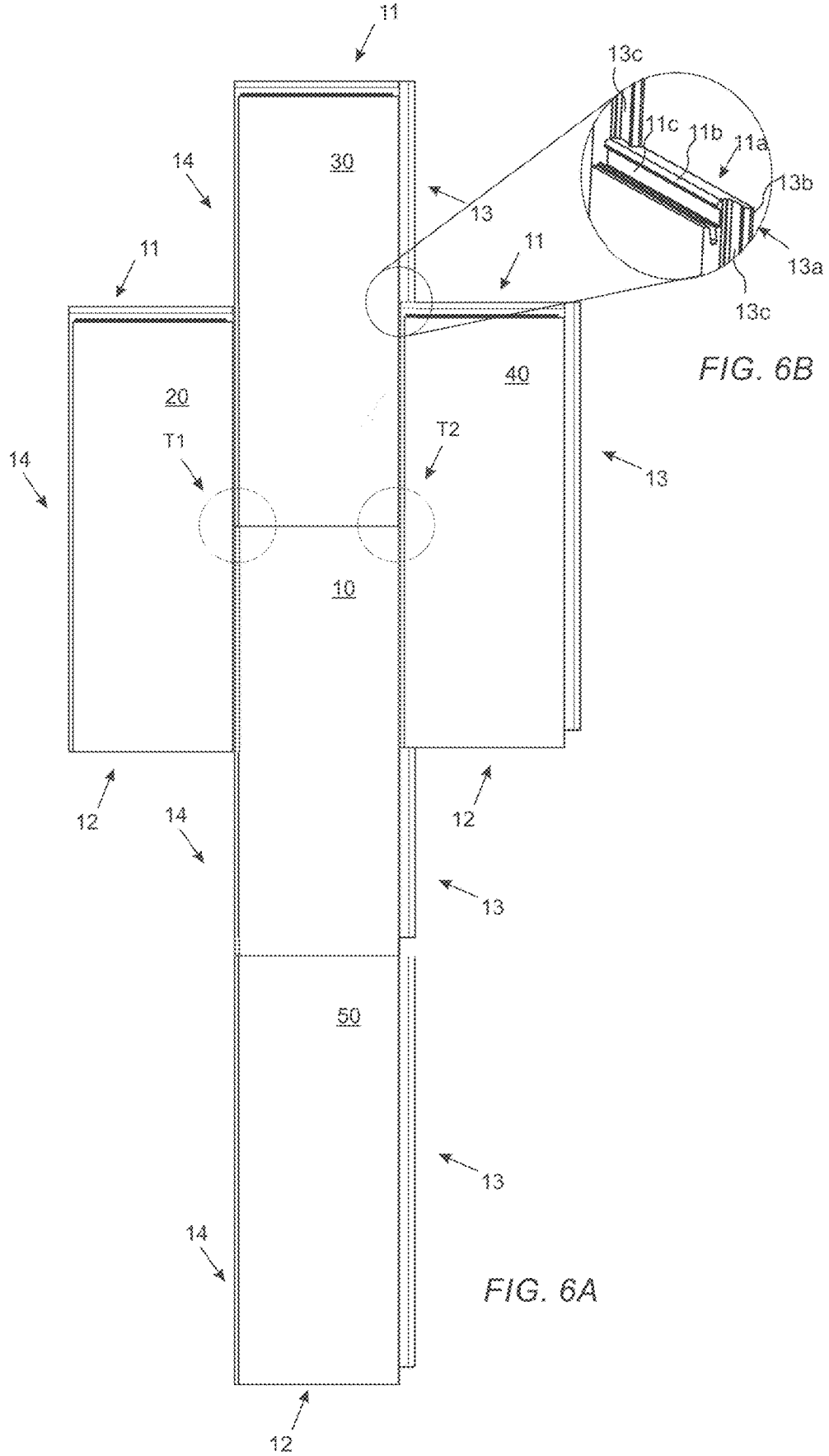
FIG. 6A is a schematic illustration of building panels according to embodiments of the disclosure being assembled in locking position.
FIG. 6B shows details of the building panels of FIG. 6A.

Referring to FIG. 6A, a panel, such as the first panel 10 may be assembled to an adjacent second panel 20 along its long fourth edge 14 by means of the first locking system, e.g. by an angling motion, thereby creating a long-side to long-side joint. The panel 10 may be further assembled with one of its short edges 11 to an adjacent third panel 30 by means of the second locking system, e.g., by vertical folding, thereby creating a short-side to short-side joint, and further assembled with its long third edge 13 to a further fourth panel 40 by means of the first locking system, e.g., by an angling motion, thereby creating a further long-side to long-side joint. The two further panels 20, 40 being arranged on opposite sides of the short-side joint. As derivable, the assembly comprises two T-joints; each T-joint comprising a long-side to long-side joint (between a third edge 13 and a fourth edge 14) and a short-side to short-side joint (between a first edge 11 and a second edge 12). Thus, the set of similar or essentially identical panels may be assembled in locking position to comprise a first T-joint T1 and a second T-joint T2, as shown for instance in FIG. 6A.

Thanks to the building panel having the features set forth in the appended independent claims, preferred embodiments being set forth in the dependent claims, it may be facilitated that the sealing of the T-joints, in particular T1, is improved.

Items

ITEM 1. A set of similar or essentially identical building panels, such as a floor or wall panels, comprising a first mechanical locking system at respective opposite and parallel third and fourth edges 13, 14, such as long edges, the first locking system comprising a first locking strip (13*a*) at one of the third edge 13 or fourth edge 14 having a first locking element 13*b* configured to cooperate for horizontal locking with a first locking groove 14*g* at the other of the third or fourth edge 13, 14 of an adjacent building panel 20, preferably by means of a folding motion, and a second locking system at respective opposite and parallel first and second edges 11, 12, such as short edges, the second locking system comprising a second locking strip 11*a* at one of the first edge 11 or second edge 12, having a second locking element 11*b* configured to cooperate for horizontal locking with a second locking groove 12*g* at the other of the first or second edge 11, 12 of an adjacent building panel 30.

ITEM 2. The set according to item 1, wherein the thickness of the second locking strip 11*a*, in a thickness-direction Z of the building panel 10, exceeds the thickness of the first locking strip 13*a*.

ITEM 3. The set according to any one of the preceding items 1 or 2, wherein the second mechanical locking system at the first and the second edge is configured to be assembled by a means of vertical motion, such as vertical folding.

ITEM 4. The set according to any one of the preceding items 1 to 3, wherein in a distance Z3, in the thickness-direction Z, between a rear surface 16 of the panel and an upper surface 11*c* of the second locking strip 11*a* exceeds a distance Z1 in the thickness-direction Z between the rear side 16 of the panel 10 and an upper surface 13*c* of the first locking strip 13*a*.

ITEM 5. The set according to any one of the preceding items 1 to 4, wherein the panels are configured such that the first upper surface 13*c* extends in a second plane 61 and the second upper surface 11*c* extends in a third parallel plane 62.

ITEM 6. The set according to item 5, wherein the third plane 62 is disposed between the plane of the front surface 15 and the second plane 61.

ITEM 7. The set according to any one of the preceding claims 1 to 6, wherein the fourth edge 14 comprises a first locking tongue 14*h* configured to cooperate with a tongue groove 13*j* of the third edge 13 for vertical locking of the third and fourth edge 14, preferably, the one of the first or second edge 11, 12 comprises a second locking tongue 11*i* configured to cooperate with a tongue groove 12*j* of the other of the first or second edge 11, 12 for vertical locking of the first and second edge 11, 12.

ITEM 8. The set according to item 7, wherein the first locking tongue 14*h* is provided with a first lower edge surface 14*f* and the second edge 12 is provided with a downwards extending locking protrusion 12*e* provided with a second lower edge surface 12*f*, wherein the first and second lower edge surfaces 14*f*, 12*f* respectively extend in vertically displaced planes.

ITEM 9. The set according to any one of the preceding items 1 to 8, wherein an end portion of the second locking strip 11*a* of a first panel 10 is configured to at least partially overlap the first locking strip 13*a* of an adjacent second building panel 20 when the first locking tongue 14*h* of the first panel 10 cooperates with the first locking strip 13*a* of the adjacent second building panel 20.

ITEM 10. The set according to the preceding items 1 to 9, wherein and end portion of the second locking protrusion 12*e* of a third panel 30 is configured to at least partially overlap said end portion of the second locking strip 11*a* of the first panel 10 and said first locking strip 13*a* of the adjacent second building panel 20 when the first, second and third 10, 20, 30 panels are mutually assembled in locked position.

ITEM 11. The set according to any one of the preceding items 1 to 10, wherein a portion of the first locking groove (14*g*) is at least partially formed in the second locking strip (11*a*), and wherein said locking groove (14*g*) opens downwards or towards the rear surface (16), wherein said portion of the first locking groove (14*g*) is configured to receive the first locking element (13*b*) of an adjacent panel (20).

ITEM 12. The set according to any one of the preceding items 1 to 11, wherein the second locking strip 11*a* extends, in the width direction W, parallel with and along essentially the entire length or the entire length of the front surface 15 of the building panel 10.

ITEM 13. The set according to any one of the preceding items 1 to 10, wherein the fourth edge 14 comprises a downwards extending locking protrusion 14*e* provided with a first lower edge surface 14*f* and the second edge 12 is provided with a downwards extending locking protrusion 12*e* provided with a second lower edge surface 12*f*.

ITEM 14. The set according to the previous item, wherein the first and second lower edge surfaces 14*f*, 12*f* respectively extend in vertically displaced planes.

ITEM 15. The set according to any one of the preceding items 1 to 14, wherein the second locking strip 11*a* and the first locking protrusion 14*e* intersect to form an integrally formed outer corner of the panel, said corner comprising a respective portion of the second locking strip 11*a* and the first locking protrusion 14*e*.

ITEM 16. The set according to any one of the preceding items 1 to 15, wherein a portion of the second locking strip 11*a* is integrally formed with an end portion of the first locking protrusion 14*e*.

ITEM 17. The set according to any one of the preceding items 1 to 16, wherein respective portions of a first 10, second 20 and third panel 30 mutually overlap to form a triple-layered joint 33 when the first locking protrusion 14*e* of the first panel 10 cooperates with the first locking strip 13*a* of the second panel 20 and the second locking strip 11*a* of the first panel 10 cooperates with the second locking protrusion 12*e* of the third panel 30.

ITEM 18. The set according to any one of the preceding items 1 to 17, wherein the second mechanical locking system comprises a locking tongue, such as a displaceable locking tongue 11*i*, provided at one of the first or second edge 11, 12 and a second tongue groove 12*j*, at the other of the first and second edge 11, 12, the locking tongue 11*i* configured to cooperate with the second tongue groove 12*j* for vertical locking of two adjacent panels.

ITEM 19. The set according to any one of the preceding items 1 to 18, wherein the building panels are rectangular.

The invention claimed is:

1. A set of similar or essentially identical building panels including a panel, comprising:

a first mechanical locking system at respective opposite and parallel third and fourth edges, the first locking system comprising a first locking strip at one of the third edge or fourth edge having a first locking element configured to cooperate for horizontal locking with a first locking groove at the other of the third or fourth edge of an adjacent building panel, wherein the third and fourth edges of the panel are asymmetric with one another and are complementary, and a second locking system at respective opposite and parallel first and second edges, the second locking system comprising a second locking strip at one of the first edge or second edge, having a second locking element configured to cooperate for horizontal locking with a second locking groove at the other of the first or second edge of an adjacent building panel, wherein the thickness of the second locking strip, in a thickness-direction of the building panel, exceeds the thickness of the first locking strip, and wherein the second locking strip extends, in a width direction, along at least an entire length of a front surface of the panel, such that the entire length of the front surface of the panel is flanked by the second locking strip.

2. The set according to claim 1, wherein the second mechanical locking system at the first and the second edge is configured to be assembled by a means of a vertical motion.

3. The set according to claim 1, wherein in a distance, in the thickness-direction, between a rear surface of the panel and an upper surface of the second locking strip exceeds a distance in the thickness-direction between the rear side of the panel and an upper surface of the first locking strip.

4. The set according to claim 1, wherein the front surface has a first plane, and wherein the panels are configured such that the first upper surface extends in a second plane and the second upper surface extends in a third parallel plane.

5. The set according to claim 4, wherein the third plane is disposed between the first plane of the front surface and the second plane.

6. The set according to claim 1, wherein the fourth edge comprises a first locking tongue configured to cooperate with a tongue groove of the third edge for vertical locking of the third and fourth edge.

7. The set according to claim 6, wherein the first locking tongue is provided with a first lower edge surface and the second edge is provided with a downwards extending locking protrusion provided with a second lower edge surface, wherein the first and second lower edge surfaces respectively extend in vertically displaced planes.

8. The set according to claim 6, wherein an end portion, in the width-direction of the panel, of the second locking strip of a first panel is configured to at least partially overlap the first locking strip of an adjacent second building panel when the first locking tongue of the first panel cooperates with the first locking strip of the adjacent second building panel.

9. The set according to claim 8, wherein an end portion, in the width-direction of the panel, of a second locking protrusion of a third panel is configured to at least partially overlap said end portion of the second locking strip of the first panel and said first locking strip of the adjacent second building panel when the first, second and third panels are mutually assembled in locked position.

10. The set according to claim 6, wherein the one of the first or second edge comprises a second locking tongue configured to cooperate with a tongue groove of the other of the first or second edge for vertical locking of the first and second edge.

11. The set according to claim 1, wherein a portion of the first locking groove is at least partially formed in the second locking strip, and wherein said locking groove opens downwards or towards the rear surface, wherein said portion of the first locking groove is configured to receive the first locking element of an adjacent panel.

12. The set according to claim 1, wherein the second locking strip extends, in the width direction, parallel with and along essentially the entire length or the entire length of the front surface of the building panel.

13. The set according to claim 1, wherein the second locking strip and the first locking protrusion intersects to form an integrally formed outer corner of the panel, said corner comprising a respective portion of the second locking strip and the first locking protrusion.

14. The set according to claim 1, wherein a portion of the second locking strip is integrally formed with an end portion of the first locking protrusion.

15. The set according to claim 1, wherein respective portions of a first, second and third panel mutually overlap to form a triple-layered joint when the first locking protrusion of the first panel cooperates with the first locking strip of the second panel and the second locking strip of the first panel cooperates with the second locking protrusion of the third panel.

16. The set according to claim 1, wherein a second locking tongue, is a displaceable locking tongue, provided at one of the first or second edge and the second tongue groove provided at the other of the first and second edge, the locking tongue configured to cooperate with the second tongue groove for vertical locking of two adjacent panels.

* * * * *